US005517229A

United States Patent [19]

Günther

[11] Patent Number: 5,517,229

[45] Date of Patent: May 14, 1996

[54] CONFIGURATION FOR ETR PRINT HEAD TRIGGERING

[75] Inventor: Stephan Günther, Berlin, Germany

[73] Assignee: Francotyn-Postalia GmbH, Birkenwerder, Germany

[21] Appl. No.: 54,887

[22] Filed: Apr. 29, 1993

[30] Foreign Application Priority Data

Apr. 29, 1992 [DE] Germany ..... 42 14 545.7

[51] Int. Cl.[6] ..... B41J 2/355; B41J 2/36; B41J 2/37

[52] U.S. Cl. ..... 347/211; 347/190

[58] Field of Search ..... 346/76 PH; 400/120, 400/120.1; 347/211, 190, 199, 118.3

[56] References Cited

U.S. PATENT DOCUMENTS

| | | | |
|---|---|---|---|
| 4,345,845 | 8/1982 | Bohnhoff et al. | 346/76 PH |
| 4,350,499 | 9/1982 | Countrymanet al. | 346/76 PH |
| 4,360,819 | 11/1982 | Saito et al. | 346/76 PH |
| 4,389,935 | 6/1983 | Arai | 346/76 PH |
| 4,404,567 | 9/1983 | Katsuragi | 346/76 PH |
| 4,531,134 | 7/1985 | Horlander | 346/76 PH |
| 4,623,899 | 11/1986 | Sakakibara | 346/76 PH |
| 5,163,760 | 11/1992 | Nardozzi | 400/120 |

FOREIGN PATENT DOCUMENTS

| | | | |
|---|---|---|---|
| 0156360 | 10/1985 | European Pat. Off. | 346/76 PH |
| 3833746 | 9/1988 | European Pat. Off. . | |
| 0301891 | 2/1989 | European Pat. Off. . | |
| 3139321 | 4/1982 | Germany . | |
| 3143784 | 7/1982 | Germany . | |
| 3512059 | 10/1985 | Germany . | |
| 0242859 | 10/1986 | Japan | 400/120 |
| 662-46659 | 2/1987 | Japan . | |
| 63-7952 | 1/1988 | Japan . | |
| 1141058 | 6/1989 | Japan . | |
| 2194852 | 3/1988 | United Kingdom . | |
| 8902825 | 4/1989 | WIPO . | |

*Primary Examiner*—Huan H. Tran
*Attorney, Agent, or Firm*—Herbert L. Lerner; Laurence A. Greenberg

[57] ABSTRACT

An ETR printing unit has electrodes and an ETR print head. A configuration for triggering the ETR print head includes a controllable energy source supplying energy for various pixels of a printed image to the electrodes of the ETR printing unit. A switching unit is provided through which the controllable energy source acts upon the electrodes temporarily connected to the energy source with a voltage or with a constant current, having a magnitude with a dependency on a temporarily different number of electrodes for supplying a larger number of electrodes with a higher voltage or a higher constant current than a lesser number would be. A microprocessor control unit for the ETR printing unit supplies the controllable energy source with a control signal corresponding to a dependency on the number of the triggered electrodes, for specifying the number of electrodes temporarily connected to the controllable energy source. A memory is connected to the microprocessor control unit.

26 Claims, 5 Drawing Sheets

CONFIGURATION FOR ETR PRINT HEAD TRIGGERING

BACKGROUND OF THE INVENTION

Field of the Invention

The invention relates to a configuration for ETR (electrothermal) print head triggering, with memory means and a control for an ETR printing unit, wherein energy from an energy source for various pixels of a printed image are furnished to the electrodes of the ETR printing unit. An ETR printer can be used in a postage meter, for instance, for franking mail.

An ETR printer includes not only mechanics but also an electronic head control, an ETR print head with a number of electrodes, and a current collector electrode, which are connected to an energy supply. The printing energy is fed as a constant current into each current path belonging to each electrode, to assure uniform print quality.

The ETR print head acts upon the recording medium, preferably paper, through a resistance ink ribbon moved along with the recording medium. The resistance ink ribbon has an upper resistor layer which is in contact with the ETR print head, a middle current return layer, and a lower ink layer that is in contact with the recording medium.

The ETR print head includes a number of electrodes that are disposed in such a way that they are insulated from one another, and each of which can generate one pixel of the printed image. The energy delivered through the electrodes is converted, in the region of the resistor layer assigned to each pixel, into electrical heat that leads to melting of the ink of the ink layer located in that region.

Published European Application No. 0 301 891 A1, corresponding to U.S. Pat. No. 5,005,993, discloses such an ETR printer with return electrodes. The energy to be delivered is dependent on the resistance of each current path assigned to a pixel, on the melting temperature of the ink, on the intended contrast of the printed image, and on the speed of the moving resistor ink ribbon, and rises non-linearly with the roughness of the surface of the paper.

German Published, Non-Prosecuted Application 38 33 746 A1 has already disclosed a switch unit being acted upon by a trigger unit, for a print head, which unlike the ETR print head, already contains the resistor elements themselves (thermotransfer printing) and has selective triggering with preheating of the resistor element to reduce the heating output in printing.

A serial/parallel shift register acted upon by the serial printing data passes the printing data in a first triggering phase to the latches of a buffer memory or store. In a second triggering phase, during a strobe pulse, each gate triggered by the associated outputs of the latches is switched open, and a trigger pulse is output to the applicable resistor element. The resistor heating elements are preheated directly, by means of a clock frequency that is adapted in both pulse height and pulse width to the necessary heating energy.

In an ETR printer, such preheating by energy from a voltage source is impossible in principle, because the resistor elements are located in the resistor layer of the resistor ink ribbon.

Since a very great number of parasitic serial resistances of variable value (junction resistance between the electrode and the ribbon, track resistance of the layer of aluminum in the ribbon, junction resistance between the ribbon and the return electrode) occur in the overall system including the ETR head with the electrodes, the ETR ribbon and the return electrode, which lead to a variation in the total resistance during operation, an energy supply by means of a voltage source is not suitable, since the varying partial voltage through the heating (printing) resistor would lead to varying printing energies. The result would be fluctuating print quality.

Energy supply to the various electrodes of an ETR head is best done, from a technical standpoint, by means of a constant current source, because a very uniform printing output can be guaranteed as a result of the accuracy of the constant current and of the specific ribbon resistance.

However, a technologically optimal construction with current regulation for each electrode path is often unsupportable in price, because of the (sometimes) very high numbers of the electrodes in an ETR head.

Structures are already known with which the attempt has been made to achieve a technologically feasible construction at acceptable expense. They includes the method of integrating a dropping, protective or multiplier resistor into each electrode path, having a resistance which is dimensioned as approximately 3 to 4 times higher than the effective heating (printing) resistance of the ETR ribbon.

Due to such an artificially increased total resistance of the system, the narrow relatively slight changes in the parasitic serial resistances in the system cannot cause any substantial change in the effective voltage across the heating resistor. In that way, the current of each electrode path has been "stabilized", and an improvement in print quality is attained as a function of a ratio between the dropping, protective or multiplier resistors and the effective heating resistance of the ETR ribbon.

Although that structure is inexpensive and technologically simple on one hand, nevertheless on the other hand it has the considerable disadvantage of needing only a fraction of the energy fed into the complete system for the actual printing process. The great majority of the energy is converted into lost heat. Moreover, a fluctuation in the voltage across the applicable heating resistor is unavoidable, because in contrast to the principle of thermal transfer printing, in the ETR printing principle, during the motion of the ribbon, varying junction resistances at the contact points of the resistor layer of the resistor ink ribbon with the electrodes of the ETR print head and of the current collector electrode, as well as varying resistor heating elements in the ribbon, are operative during the motion of the ribbon.

SUMMARY OF THE INVENTION

It is accordingly an object of the invention to provide a configuration for ETR print head triggering, which overcomes the hereinafore-mentioned disadvantages of the heretoforeknown devices of this general type and which provides a technological way of triggering an arbitrary ETR print head that combines a simple and therefore economical technological construction with minimal power loss in the system and therefore only entails low operating costs, while at the same time the print quality is maximal.

With the foregoing and other objects in view there is provided, in accordance with the invention, in an apparatus having an ETR printing unit with electrodes and an ETR print head, a configuration for triggering the ETR print head, comprising a controllable energy source supplying energy for various pixels of a printed image to the electrodes of the ETR printing unit; a switching unit through which the controllable energy source acts upon the electrodes temporarily connected to the energy source with a voltage or with a constant current, having a magnitude with a dependency on a temporarily different number of electrodes for supplying a larger number of electrodes with a higher voltage or a higher constant current than a lesser number would be; a microprocessor control unit for the ETR printing unit supplying the controllable energy source with a control signal corresponding to a dependency on the number of the triggered electrodes, for specifying the number of electrodes temporarily connected to the controllable energy source; and memory means connected to the microprocessor control unit.

The invention assumes that the configuration for ETR print head triggering is equipped with memory means and with control means for the ETR print unit, and the triggering of an ETR print head within a printing system is carried out entirely with the aid of microprocessors, microcomputers or computers, and energy for the various pixels of the printed image is furnished to the electrodes of an ETR print unit from a voltage source. The number of electrodes temporarily connected to the controllable voltage source is specified by a microprocessor control that outputs a control signal corresponding to the dependency on the number of triggered electrodes, to the controllable voltage source.

The invention is also based on the concept that with a microprocessor control unit, the relevant print information at any given time is loaded into the switching unit at the correspondingly correct moment. In the active state, the switching unit assures that the pixels to be printed have current supplied to them for a defined period of time, in order for the heat required for the printing process to be generated in the ETR ribbon.

In accordance with another feature of the invention, the controllable energy source is a digitally triggerable voltage source connected directly with control outputs of the microprocessor control unit, the voltage source supplies a voltage, and there is provided a measuring resistor across which a total current flows.

In accordance with a further feature of the invention, there is provided a D/A converter for analog-triggering of the controllable voltage source, the D/A converter having digital inputs connected to outputs of the microprocessor control unit, and a control element having means for at least one of adjusting a basic amplification and adapting a printing intensity to a set printing speed.

In accordance with an added feature of the invention, the switching unit has outputs each having a current source character for the electrodes of the ETR printing unit or dropping, protective or multiplier resistors for the electrodes.

In accordance with an additional feature of the invention, there is provided a resistor in each current path for adjusting each current source or current distribution.

In accordance with yet another feature of the invention, there is provided a one dropping, protective or multiplier resistor being located in each current path and assigned to the ETR electrodes, preferably having one-half to one-eighth the resistance of an effective resistor heating element.

In accordance with yet a further feature of the invention, the controllable voltage source has a triggering input for a control voltage and a connection for additional regulation of a print quality by means of a measuring voltage, and including an inverting amplifier having a node point, a first resistor applying the measuring voltage to the node point, and a second resistor applying the inverted control voltage to the node point, or including a subtracting amplifier having inverting and non-inverting inputs, a first resistor applying the measuring voltage to the inverting input, and a second resistor applying the non-inverted control voltage to the non-inverting input or the non-inverted control voltage being applied directly to the non-inverting input.

In accordance with yet an added feature of the invention, the switching unit receives relevant printing information for a given time at a correspondingly correct time in a first trigger phase, and the microprocessor control unit controls the switching unit in such a way that in an activated state of gates on an output side of a driver, during a second trigger phase, resistor heating elements in an ETR ribbon being assigned to the pixels to be printed are supplied with current for a defined period of time corresponding to a selected printing speed, so that requisite heat for a printing process is generated in the ETR ribbon.

In accordance with yet an additional feature of the invention, the switching unit has a decoder with an input side being acted upon with at least one of data, commands and signals by the microprocessor control unit.

In accordance with again another feature of the invention, there is provided another unit having components, such as microprocessors having memories, microcomputers or computers, the triggering of the ETR print head within the printing unit being carried out entirely with the components.

In accordance with a concomitant feature of the invention, the ETR print head to be triggered is part of a postage meter.

Other features which are considered as characteristic for the invention are set forth in the appended claims.

Although the invention is illustrated and described herein as embodied in a configuration for ETR print head triggering, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENT

Figure 1:
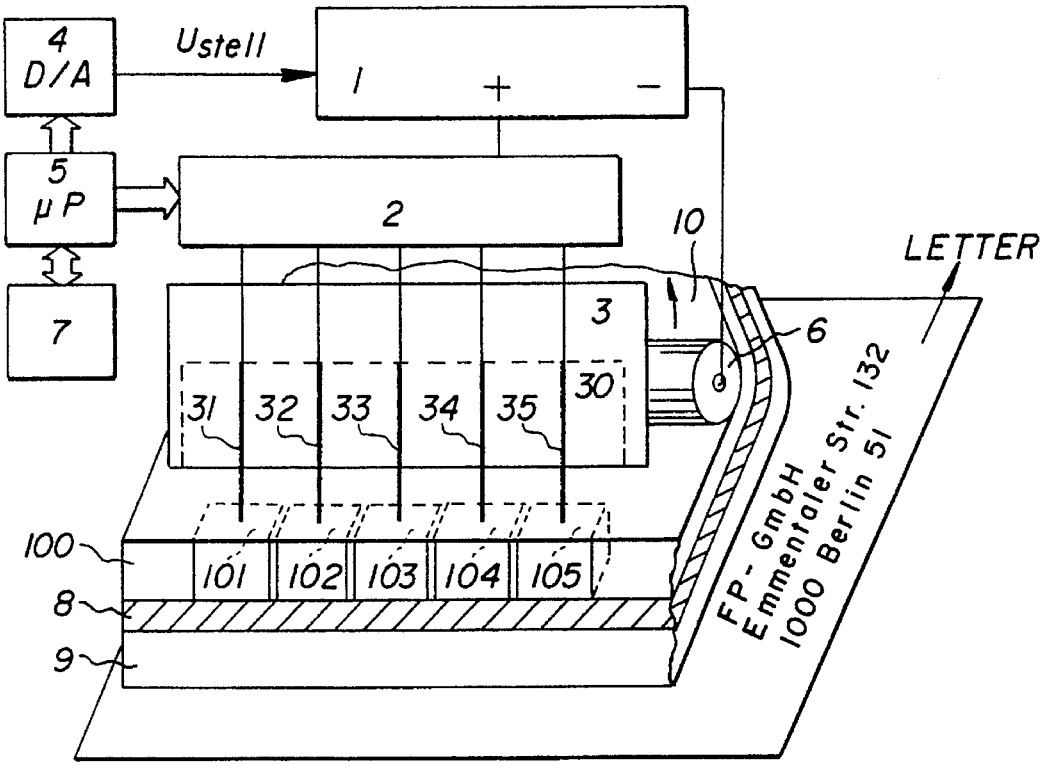
FIG. 1 is a fragmentary, diagrammatic, partly sectional, perspective view with a block circuit diagram of a configuration according to the invention.

Referring now to the figures of the drawing in detail and first, particularly, to FIG. 1 thereof, there is seen a configuration for ETR print head triggering which has a controllable energy source 1, a switching unit 2, an ETR printing unit 3, a microprocessor unit 5, a current collector electrode 6, and memory means 7, which are connected to the microprocessor control unit 5 for triggering the ETR printing unit 3. The memory means 7 contain at least graphic data for one printed image.

Energy for electrodes of the ETR printing unit 3 is furnished from the single controllable energy source 1. A number n of electrodes 31, 32, 33, . . . that are temporarily connected to the controllable energy source 1 is specified by the microprocessor control unit 5, which additionally outputs a control signal to the controllable energy source 1, wherein the control signal corresponds to the dependency on the number of triggered electrodes.

The switching unit 2, that is acted upon through the microprocessor control unit 5, passes the energy on to an ETR print head 30 of the ETR printing unit 3 that is in contact with an ETR resistor ink ribbon 10 through the electrodes 31, 32, 33, . . . The relevant printing information at any given time is loaded at a correspondingly correct moment $t_1$ into the switching unit 2, which in an activated state from a time $t_2$ assures that the pixels to be printed are supplied with current for a defined period of time $t_j$, so that the heat required for the printing process is generated in triggered, briefly electrically contacted regions 101, 102, . . . of a resistor layer 100 of the resistor ink ribbon 10.

Figure 2:
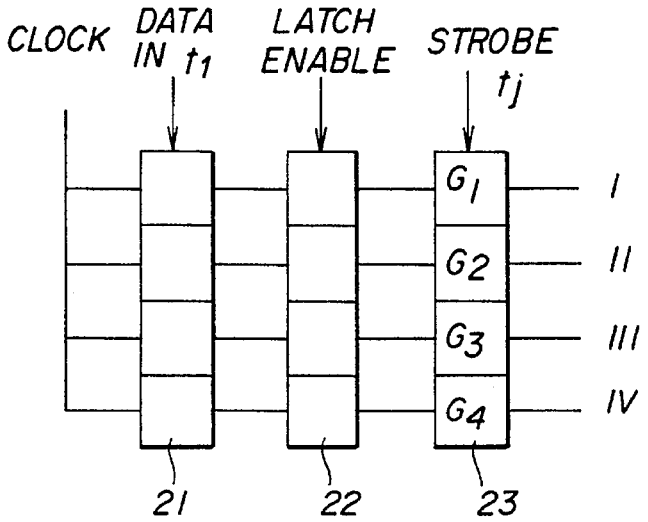
FIG. 2 is schematic diagram of a circuit of a switching unit.
Figure 9:
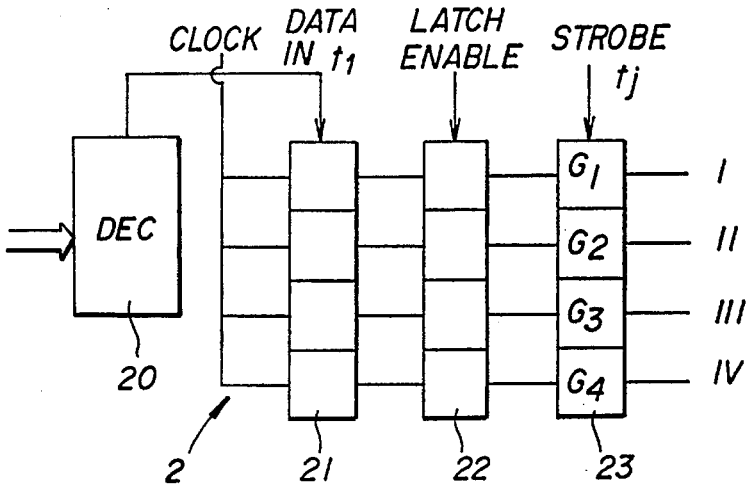

FIG. 2 shows a circuit of the switching unit 2. A serial/parallel shift register 21 of the switching unit 2, which is acted upon by the serial printing data directly or through a decoder 20 as shown in FIG. 9 sends the printing data in a first triggering phase, beginning at the time $t_1$, to latches of a buffer memory or store 22. Accordingly, the current printing information is available in the control unit 2 for a sufficiently long time prior to the actual printing process.

In a second trigger phase beginning at the time $t_2$, each gate $G_1$, $G_2$, . . . triggered by the associated outputs of the latches of a driver 23 on the output side is switched open during one strobe pulse, and a trigger pulse is output to the appropriate current path at the associated resistance $R_p$. An SN 75518 triggering circuit with a 32-bit shift register, 32 latches and 32 AND gates can advantageously be used as the switching unit 2. Once a predetermined period of time has elapsed, the new printing data are furnished by the microprocessor control unit 5 and stored in the latches of the buffer memory 22.

In order to provide a constant print quality, the printer driver is set in such a way that for each ribbon speed $V_{bj}$, where j=1, 2, . . . , m, the following equation applies:

$$t_j * V_{bj} = c, \text{ where } c \text{ equals } a \text{ constant} \quad (1)$$

Figure 3A:
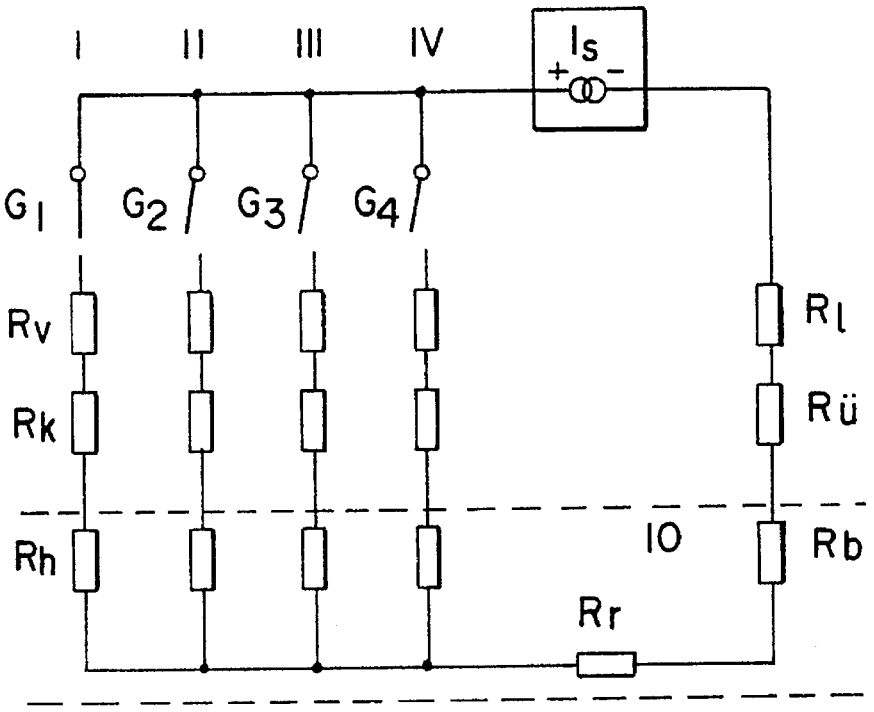
FIG. 3*a* is an electrical substitute circuit diagram for ETR printers having a single constant current source $I_s$.

FIG. 3*a* shows an electrical substitute circuit diagram for ETR printers with a current path selected, having the associated resistance $R_p$ and a single constant current source $I_s$. The resistance $R_p$ is a sum of resistances as follows:

$$R_p = R_v + R_k + R_h + R_r + R_b + R_{ü} + R_l \quad (2)$$

where the symbols have the following meanings:

$R_v$: heating resistor $R_k$: contact resistor of an electrode $R_h$: resistance heating element $R_r$: current return resistance $R_b$: ribbon resistance $R_{ü}$: junction resistance between the ribbon and the return electrode $R_l$: line resistance The contact resistance $R_k$ of an electrode having the upper resistor layer 100 of the resistance ink ribbon 10 is dependent on the size of the effective electrode surface area and on the contact pressure against the ribbon. The current return resistance $R_r$ of a middle layer 8 of the resistance ink ribbon preferably is formed of aluminum and depends on the total current and on the distance from the return electrode. The aluminum layer 8 is approximately 0.8 μm thick, as compared with the resistor layer 100 which is approximately 15 μm and as compared with an ink layer 9 having a thickness which is approximately 6 μm. If the current collector electrode 6 is disposed near the electrodes of the ETR print head 30, the current return resistance $R_r$ is negligibly low. The ribbon resistance $R_b$ of the resistor layer 100 of the resistance ink ribbon 10 is determined by a contact angle β of the surface of the return electrode 6. The junction resistance $R_{ü}$ between the ribbon 10 and the current collector electrode 6 depends on the pressure and on the return electrode surface area.

The resistance heating elements $R_h$ are triggered by a clock frequency which is adapted in its pulse height and pulse width to the required heating energy. An energy $W_p$, in each resistance heating element $R_h$, that determines the print quality, thus becomes as follows:

$$W_p = (I_{p2} * R_h) * t_j = (U_{h2}/R_h) * t_j \quad (3)$$

The requisite pulse height is furnished by the triggered energy source 1, which acts upon the electrodes 31, 32, 33, . . . that are temporarily connected to it through the switching unit 2, with a current $I_s$ or a voltage $U_s$, having a magnitude which has a dependency on the temporarily different number n of triggered electrodes in such a way that a larger number of electrodes is supplied with a higher current or with a higher voltage than a lesser number would be.

In the first variant shown in FIG. 1, an analog-triggerable energy source 1 is provided, which is triggerable by the analog output of a digital/analog converter 4, that is connected by its digital inputs to outputs of the microprocessor control unit 5.

In the case of each current print column, the number n of printing points to be activated is output, in binary coded form, to the D/A converter 4 of the microprocessor control unit 5, prior to the outputting of the printing information to the switching unit 2 in accordance with that number. Even with a simple eight-bit D/A converter, 256 different analog levels can be generated in this way, which correspond directly to the applicable number of pixels to be printed. These analog levels serve to trigger a triggerable and adjustable energy source 1. Accordingly, a defined energy, corresponding exactly to the number of pixels to be printed in each printing column, is fed into the system.

This has the advantage firstly of enabling a single controllable and adjustable constant current source $I_s$, for instance, to be sufficient for the entire system having arbitrarily many ETR electrodes, rather than one such current source having to be made available for each current path. Secondly, only a very small heating resistor $R_v$ is then necessary in each current path I, II, III, . . . for adjusting the current distribution. At the same time, however, because of the controllable constant current source for each printed column, provision is made for the precise predetermined printing energy to always be available for melting the lower ink layer 9. The following equation is approximately valid for the controllable constant current:

$$I_s=(I_{p1}+I_{p2}+\ldots+I_{pi}) \quad (4)$$

The resistance of the heating resistor $R_v$ is one-half to one-eighth that of the effective heating resistor and preferably one-third to one-fourth of it, which minimizes the energy loss of the system as compared with the aforementioned prior art, with a very much larger resistor $R_v$. If $R_h+R_v>R_r+R_b+R_{ü}+R_l$, the losses are minimal Another advantage of this invention is based on the fact that the printing intensity of the entire ETR head can be very easily achieved by varying a single control element S, and current source $I_s$ or constant voltage $U_s$ of the controllable namely by varying a factor y of the controllable constant energy source 1. If a further factor z is varied with the same control element S, the print speed or ribbon speed $V_b$can additionally be taken into account.

If the print speed $V_b$ and print intensity (contrast) increase, then the factors y and z increase as well. Since the partial currents in the current paths are equal, and the relationship $I_p=I_{p1}=I_{p2}=\ldots=I_{pi}$ is established by means of the dropping, protective or multiplier resistors $R_v$, the following equation applies:

$$I_s=y*z*n*I_p \quad (5)$$

Figure 3B:
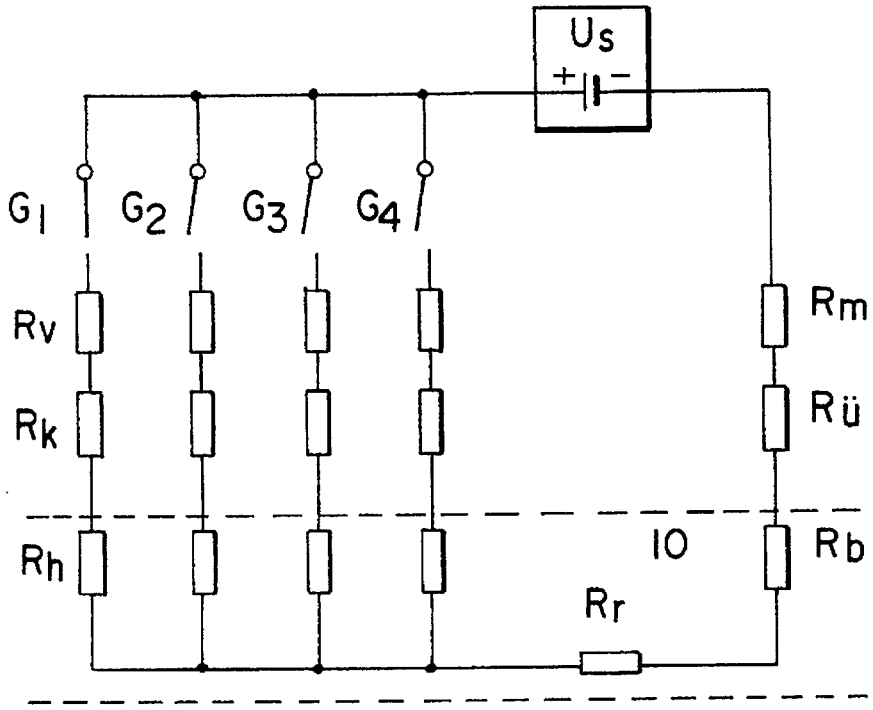
FIG. 3*b* is an electrical substitute circuit diagram for ETR printers having a single constant voltage source $U_s$.

FIG. 3*b* shows an electrical substitute circuit diagram for ETR printers with a single constant voltage source $U_s$. When the voltage source $U_s$ is used as the energy source 1, provision is made, by incorporating a serial measuring resistor $R_m$ into the current circuit, for linearizing the voltage drop across the residual resistor $R_{rest}=R_r+R_b+R_{ü}+R_m$. If $R_m>>R_r+R_b+R_{ü}$, then the following equation approximately applies:

$$R_{rest}=R_m \quad (6)$$

Since the current $I_p$ of each current path flows across the measuring resistor $R_m$ (which includes the line resistor $R_l$), the total current $I_g=n*I_p$ can be measured through $U_m$. The following equation applies:

$$U_m=n*I_p*R_m \quad (7)$$

If only one current path is included, in other words the smallest unit that corresponds to the value of one ETR electrode, then the factor n=1.

The controllable constant voltage, taking n current paths into account, then becomes as follows:

$$U_s=y*z*(U_1+[n*U_2]) \quad (8)$$

In this case, the following equation applies:

$$U_1=U_v+U_k+U_h, \text{ and } U_2=R_{rest}*I_p \quad (9)$$

The adjustment times of the controllable energy source 1 are not critical, with a view to the maximum printing speeds in the range of approximately 500 mm/s that can be attained with ETR technology. The engineering effort and expense is comparatively low, for optimal printing results.

Figure 4:
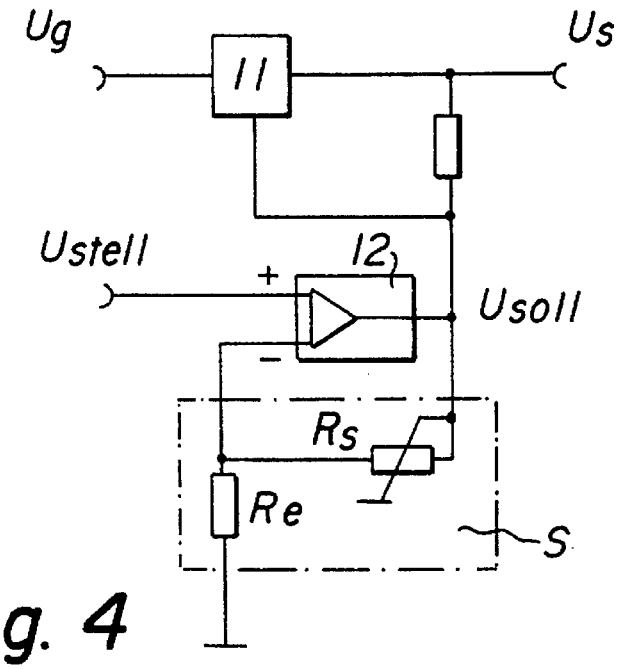
FIG. 4 is a schematic and block circuit diagram of a variant of a controllable voltage source.

FIG. 4 presents a variant of a controllable voltage source, having a linear regulator 11, which is supplied with an unregulated input voltage $U_g$ and a command value amplified through a non-inverting operational amplifier 12, and which outputs a voltage $U_s$ on its output side. The command value voltage is obtained from the analog control voltage as follows:

$$U_{soll}=(1+R_s/R_e)*U_{stell} \quad (10)$$

Figure 5:
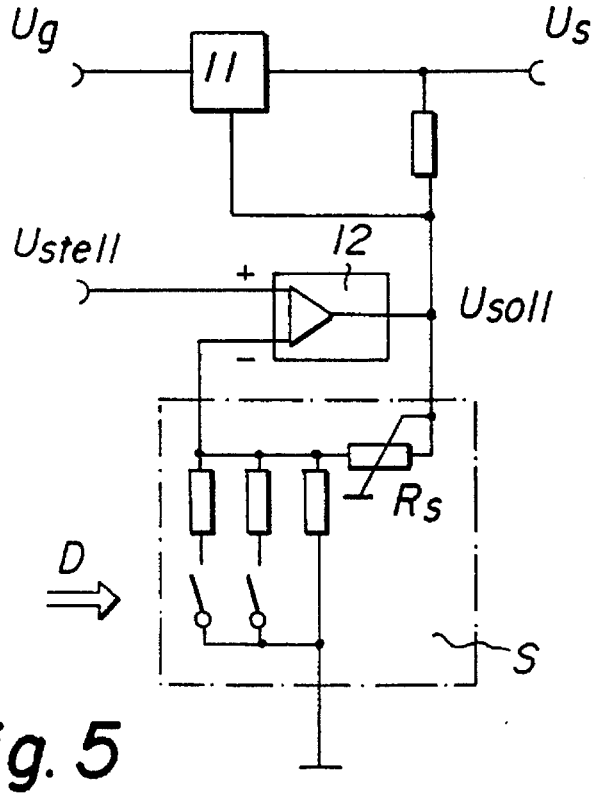
FIG. 5 is a schematic and block circuit diagram of a variant for an arbitrary printing speed and for adjustable contrast.

A resistance ratio $R_s/R_e$ of a control element S permits the adjustment of the basic amplification and/or a switchover of a resistor chain corresponding to the required factors y and z, which switchover is controlled by the microprocessor control unit 5 and is shown in FIG. 5.

Figure 6:
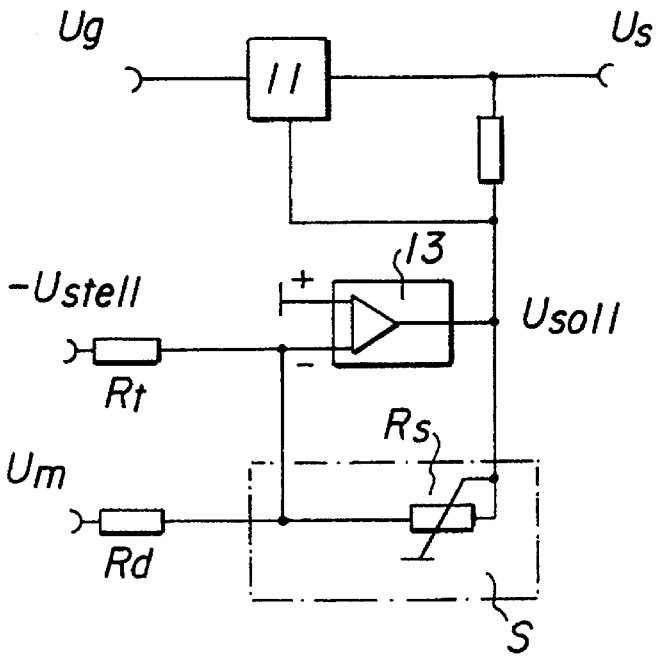
FIG. 6 is a schematic and block circuit diagram of a variant for additional regulation of the print quality with an inverting amplifier.

FIG. 6 shows a further variant for a controllable voltage source, which is equipped with a connection for additionally regulating the print quality by means of the measuring voltage $U_m$. The measuring voltage drops at the measuring resistor $R_m$, which is smaller by orders of magnitude than the dropping, protective or multiplier resistors $R_v$ or the heating resistors $R_h$ and is less than the current return resistance $R_r$. The measuring voltage $U_m$, through a first resistor $R_d$, and an inverted control voltage $U_{stell}$, through a second resistor $R_l$, is located at a node point of an inverting amplifier 13. As the total resistance rises, the total current decreases, and accordingly $U_m$ also decreases, which leads to an increase in a command voltage $U_{soll}$.

Figure 7:
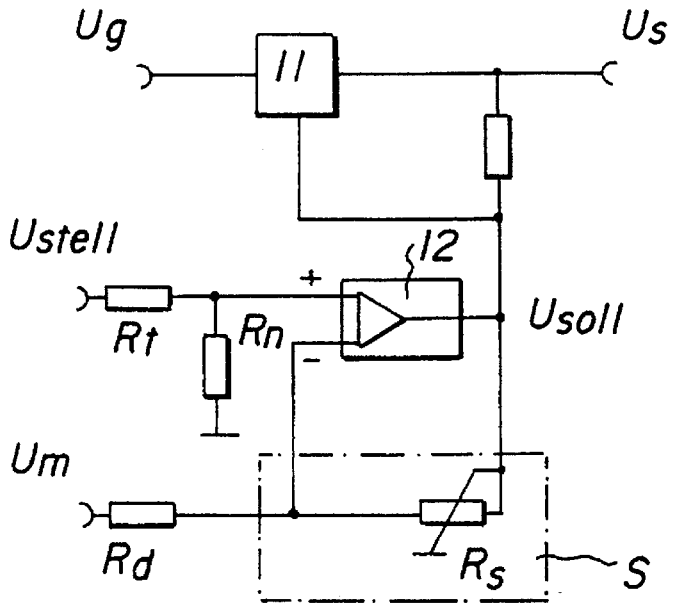
FIG. 7 is a schematic and block circuit diagram of a variant for an additional regulation of the print quality with a subtracting amplifier.

FIG. 7 shows a further variant for a controllable voltage source with additional regulation. The amplifier 12 is constructed as a subtracting amplifier. Unlike the variant of FIG. 6, positive voltages $U_{stell}$ and $U_m$ can be applied on the input side, while the mode of operation is otherwise the same.

Figure 8:
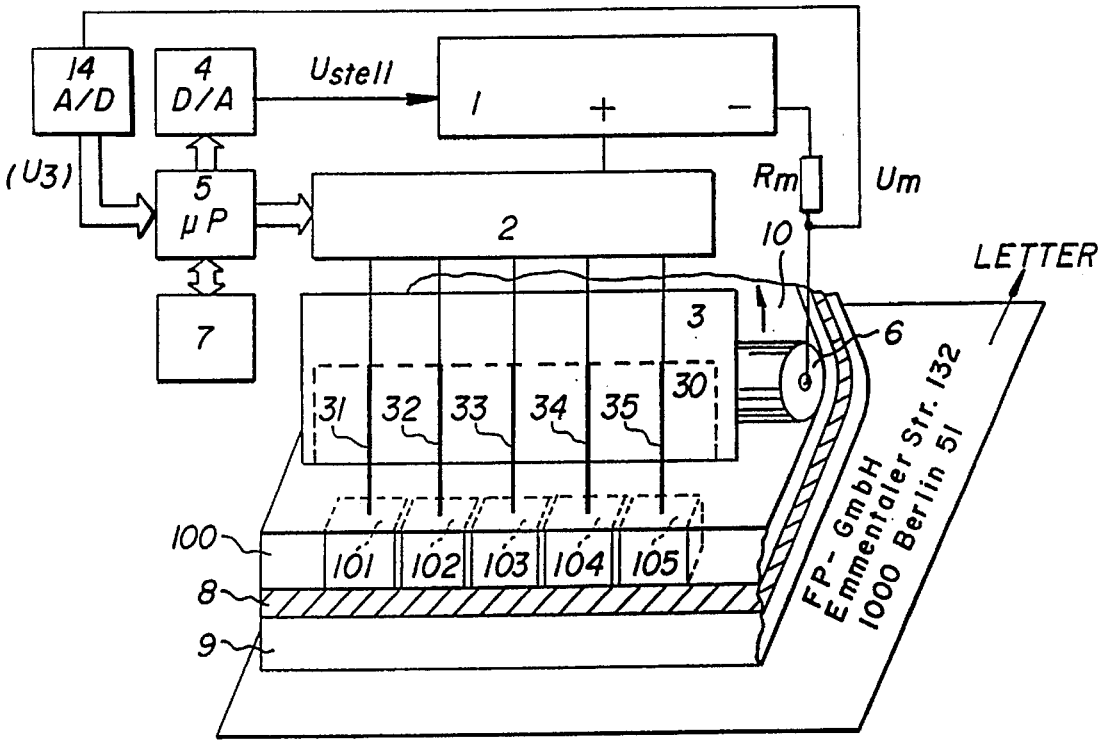

A further variant for a controllable voltage source with digital control inputs, for correspondingly adjusting the selected printing speed, for adjusting the contrast per se, and with additional regulation of the print quality by means of the measuring voltage $U_m$, is illustrated by FIG. 5 in combination with an expansion of the block circuit diagram, that is not shown in FIG. 1, but which will be discussed below. The microprocessor unit 5 is additionally equipped on the input said with an analog/digital converter 14 as shown in FIG. 8, at an input of which the measuring voltage $U_m$ is applied. The digital data corresponding to the measuring voltage $U_m$ are input into the microprocessor unit 5 and form a correction variable, which additionally enters into the aforementioned equation (8). The following equation thus results for the control voltage:

$$U_{stell}=(U_1-U_3+[n*U_2]) \quad (11)$$

In a further variant that is not shown in FIG. 1, a digitally triggerable energy source 1 (current source $I_s$ or voltage source $U_s$) is connected directly to the outputs of the microprocessor control unit 5.

For instance, the number n of the electrodes temporarily connected to the controllable current source $I_s$ is specified directly by the microprocessor control unit 5, which outputs a control signal to the controllable energy source 1 that corresponds to the dependency on the number n of triggered electrodes, so that each resistance heating element $R_p$ brings to bear the requisite uniform heating output in printing.

If the ETR printer is used for a postage meter, then the memory and the microprocessor control unit of the postage meter can be jointly used for triggering purposes. A postage meter of this kind includes memory means and receiving means connected to it, for data which can be transmitted through transmission means, input means, a control module, and the ETR printer.

The invention is not limited in its structure to the preferred exemplary embodiment described above. On the contrary, there are a number of conceivable variants, which make use of the provisions described and illustrated herein, even in embodiments that are fundamentally different.

I claim:

1. In an apparatus having a printing unit with a print head having a plurality of print head elements for printing individual pixels of a print image, a configuration for triggering the print head, comprising:

a microprocessor control unit and a memory connected to said microprocessor control unit;

a controllable voltage source connected to said microprocessor control unit;

a switching unit connected between said control unit and the print head elements of the print head for temporarily connecting a number of the print head elements to said voltage source and for supplying a voltage from said voltage source to the number of the print head elements connected during a predetermined actuation time by said switching unit;

said voltage source being controlled by said control unit in accordance with the number of the temporarily connected print head elements such that a relatively greater number of print head elements is supplied with a relatively greater voltage than a relatively smaller number of print head elements; and said microprocessor control unit calculating a control parameter for controlling said voltage source from a first constant voltage and from a second constant voltage multiplied by the number of the temporarily connected print head elements.

2. The configuration according to claim 1, wherein said controllable voltage is a digitally triggerable voltage source connected directly with control outputs of said microprocessor control unit, said voltage source supplies a voltage, and including a measuring resistor across which a total current flows.

3. The configuration according to claim 1, including a D/A converter for analog-triggering of said controllable voltage source, said D/A converter having digital inputs connected to outputs of said microprocessor control unit, and a control element having means for adjusting a basic amplification to a set printing speed.

4. The configuration according to claim 1, wherein said switching unit has dropping resistors for the electrodes.

5. The configuration according to claim 4, wherein each connection from said voltage source to a respective one of print head element defines a current path, including a resistor in each current path for adjusting each current source or current distribution.

6. The configuration according to claim 5, including one dropping resistor connected in each current path and assigned to the each print head element.

7. The configuration according to claim 6, wherein said print head prints through a print ribbon which includes effective resistor heating elements and wherein said dropping resistor has one-half to one-eighth a resistance of an effective resistor heating element.

8. The configuration according to claim 1, wherein said controllable voltage source has a triggering input for a control voltage and a connection for additional regulation of a print quality by means of a measuring voltage, and including an inverting amplifier having a node point, a first resistor applying the measuring voltage to said node point, and a second resistor applying the control voltage in an inverted state to said node point.

9. The configuration according to claim 1, wherein said controllable voltage source has a triggering input for a control voltage and a connection for additional regulation of a print quality by means of a measuring voltage, and including a subtracting amplifier having inverting and non-inverting inputs, a first resistor applying the measuring voltage to the inverting input, and a second resistor applying the control voltage in a non-inverted state to the non-inverting input.

10. The configuration according to claim 1, wherein said controllable voltage source has a triggering input for a control voltage and a connection for additional regulation of a print quality by means of a measuring voltage, and including a subtracting amplifier having inverting and non-inverting inputs, a first resistor applying the measuring voltage to the inverting input, and the control voltage being applied directly to the non-inverting input in a non-inverted state.

11. The configuration according to claim 1, wherein said switching unit receives relevant printing information for a given time at a correspondingly correct time in a first trigger phase, and said microprocessor control unit controls said switching unit in such a way that in an activated state of gates on an output side of a driver, during a second trigger phase, resistor heating elements in an ETR ribbon being assigned to the pixels to be printed are supplied with current for a defined period of time corresponding to a selected printing speed, so that requisite heat for a printing process is generated in the ETR ribbon.

12. The configuration according to claim 11, wherein said switching unit has a decoder with an input side being acted upon with at least one of data, commands and signals by said microprocessor control unit.

13. The configuration according to claim 1, including another unit having components, the triggering of the ETR print head within the printing unit being carried out entirely with said components.

14. The configuration according to claim 13, wherein said components are microprocessors having memories.

15. The configuration according to claim 13, wherein said components are microcomputers.

16. The configuration according to claim 13, wherein said components are computers.

17. The configuration according to claim 13, wherein the ETR print head to be triggered is part of a postage meter.

18. The configuration according to claim 1, including a D/A converter for analog-triggering of said controllable voltage source, said D/A converter having digital inputs connected to outputs of said microprocessor control unit, and a control element having means for adapting a printing intensity to a set printing speed.

19. In an apparatus having an ETR printing unit with an ETR print head having a plurality of electrodes for printing individual pixels of a print image, a configuration for triggering the ETR print head, comprising:

a microprocessor control unit and a memory connected to said microprocessor control unit;

a controllable constant current source connected to said microprocessor control unit;

a switching unit connected between said control unit and the electrodes of the ETR printing unit for temporarily connecting a number of the electrodes to said constant current source and for supplying a current from said constant current source to the number of the electrodes connected during a predetermined actuation time by said switching unit;

said constant current source being controlled by said control unit in accordance with the number of the temporarily connected electrodes such that a relatively greater number of electrodes is supplied with a relatively greater current than a relatively smaller number of electrodes; and said microprocessor control unit having means for calculating a control parameter for controlling said constant current source from a first constant and from a second constant multiplied by the number of the temporarily connected electrodes.

20. The configuration according to claim 19, wherein said switching unit has outputs each having a current source character for the electrodes of the ETR printing unit.

21. The configuration according to claim 20, wherein each connection from said constant current source to a respective one of the electrodes defined a current path, including a resistor connected in each current path for adjusting a current supplied to each electrode of the number of electrodes.

22. The configuration according to claim 21, including one dropping resistor connected in each current path and assigned to each electrode.

23. The configuration according to claim 22, wherein said print head prints through a print ribbon which includes effective resistor heating elements and wherein said dropping resistor has one-half to one-eighth a resistance of an effective resistor heating element.

24. Configuration according to claim 19, which further comprises a D/A converter having digital inputs connected with outputs of said microprocessor control unit, said controllable constant current source being controllable in an analog manner through said D/A converter, and a control element for adjusting a basic amplification and for adjusting a printing intensity to a predetermined print speed.

25. A configuration for triggering a print head having a plurality of print head elements for printing individual pixels of a print image, the configuration comprising:

a microprocessor control unit and a memory connected to said control unit;

a regulated voltage source connected with said microprocessor control unit;

a switching unit connected to said control unit, said switching unit connecting said control unit to the print head elements of the print head and said control unit triggering said switching unit so as to supply the print head elements during a predetermined time period with energy from said regulated voltage source for individual pixels of a print image, and said control unit controlling the energy supplied to the print head in accordance with a number of temporarily triggered print head elements and supplying a relatively greater number of print head elements with a relatively greater voltage and supplying a relatively smaller number of print head elements with a relatively smaller voltage;

said microprocessor control unit forming a control voltage for operating the print head by adding a first, constant voltage and a second voltage corresponding to a constant voltage multiplied with the number of temporarily triggered print head elements and by factoring in a factor representative of an adjusted print intensity.

26. The configuration according to claim 25, wherein the print head is an ETR print head, the plurality of print head elements are a plurality of electrodes, and the ETR print head prints through an ETR print ribbon having an effective resistor heating element, and the print head defining a contact resistor, said regulated voltage source, the ETR print head and the ETR print ribbon define a current path, wherein said switching unit has dropping resistors for the electrodes, wherein said regulated voltage source is a digitally triggered voltage source and said microprocessor control unit has control outputs directly connected to said regulated voltage source and outputting a total voltage proportional to a sum of the current; accordingly, it is quite clear that this has to do with the regulation of a flowing total current and the calculation of the power is taken into consideration.

* * * * *

UNITED STATES PATENT AND TRADEMARK OFFICE

CERTIFICATE OF CORRECTION

PATENT NO. : 5,517,229

DATED : May 14, 1996

INVENTOR(S) : Stephan Guenther

It is certified that error appears in the above—identified patent and that said Letters Patent is hereby corrected as shown below:

TITLE PAGE:

Item (73) should read as follows:

-- Francotyp-Postalia GmbH --.

Signed and Sealed this

Twenty-first Day of January, 1997

*Attest:*

*Attesting Officer*

BRUCE LEHMAN

*Commissioner of Patents and Trademarks*